US007028360B2

(12) United States Patent
Eldar

(10) Patent No.: US 7,028,360 B2
(45) Date of Patent: Apr. 18, 2006

(54) MULTI-FUNCTIONAL HAND TOOL FOR PUNCHING HOLES AND INSERTING FITTINGS IN IRRIGATION PIPES

(76) Inventor: Mordechai Eldar, Odem St. 12, Or Yehuda (IL) 60406

( * ) Notice: Subject to any disclaimer, the term of this patent is extended or adjusted under 35 U.S.C. 154(b) by 0 days.

(21) Appl. No.: 11/016,795

(22) Filed: Dec. 20, 2004

(65) Prior Publication Data

US 2005/0166331 A1 Aug. 4, 2005

(30) Foreign Application Priority Data

Jan. 13, 2004 (IL) ..... 159909

(51) Int. Cl.
*B25F 1/00* (2006.01)

(52) U.S. Cl. ..... 7/157; 7/158

(58) Field of Classification Search ..... 7/157, 7/158; 30/359; 451/356; 29/268
See application file for complete search history.

(56) References Cited

U.S. PATENT DOCUMENTS 1,335,660 A * 3/1920 Conley ..... 7/157
3,181,238 A * 5/1965 Liggio ..... 30/94
4,416,407 A * 11/1983 Bone ..... 227/67
4,847,997 A * 7/1989 Petty ..... 30/95
5,829,142 A * 11/1998 Rieser ..... 30/93
6,134,997 A * 10/2000 Rosanova ..... 82/92
6,789,717 B1 * 9/2004 Ueno et al. ..... 227/67
6,862,766 B1 * 3/2005 Geurts ..... 7/157
2005/0076513 A1 * 4/2005 Brailovskiy ..... 30/250

* cited by examiner

*Primary Examiner*—David B. Thomas
*Assistant Examiner*—Robert Scruggs
(74) *Attorney, Agent, or Firm*—Ostrolenk, Faber, Gerb & Soffen, LLP

(57) ABSTRACT

A multi-functional hand tool for punching holes into plastic piping and for inserting fittings, primarily intended for use in making holes in irrigation pipes of all sizes, with holes of 2–5 mm in diameter, and for inserting drips and sprinklers into the pipes. The tool comprises of a set of different-sized easily interchangeable cylindrical blades made of steel, preferably hardened and provided with a sharpened around cutting edge, and a variety of recesses that can accommodate different sized fittings for the intent of inserting them into the piping, and a small cutting blade for cutting the irrigation piping of up to 20 mm to the required length, and a special hollow for holding start connectors during the insertion operation.

10 Claims, 5 Drawing Sheets

3b-3b

MULTI-FUNCTIONAL HAND TOOL FOR PUNCHING HOLES AND INSERTING FITTINGS IN IRRIGATION PIPES

BACKGROUND OF THE INVENTION

1) Field of the Invention

The invention generally relates to producing holes and to the insertion of fittings into these holes, and more specifically relates to a hand tool for punching holes preferably in polythelene irrigation pipes of which there are two types. The one leaves the factory already equipped with drips installed at regular intervals and the second is a so-called plain pipe that has to have the holes punched in it when the pipe is laid out in the field or garden and have the drips installed afterwards. The invention relates substantially to the second type of pipes, although it can be used in connection with the first type as well, when there may be necessity to add holes. The invention also can be used for producing holes in any flexible plastic piping.

2) Description of the Prior Art

In agriculture and gardening the irrigation piping is generally made of polythelene, into which holes of various sizes are punched for the insertion of drippers and sprinklers, and the piping is cut to the required length.

Up till now these processes were executed by separate tools each performing one operation each: a) single-sized hole punch; b) single type inserter tool; c) a pipe length cutter tool; d) a tool for inserting start connectors into the piping.

To this purpose it was necessary to go out to the fields or gardens with a large variety of tools, each tool performing one operation, this being awkward, inconvenient and complicated.

SUMMARY OF THE INVENTION

Against the described background it is therefore a general object of the invention to provide a multi-functional hand tool that combines a possibility for performing a variety of different operations in one single tool, incorporating in it the elements necessary for punching different sized holes into the piping, inserting a variety of fittings and components, and for cutting the piping to its' required length. All this considerably facilitates the various operations performed especially in the field or garden, and should be seen as a progressive invention of extreme benefit and an immense versatile improvement on all the prior art.

The accompanying drawings, which are incorporated in and form a part of the specification, illustrate preferred embodiments of the present invention and together with the description, serve to explain the principles of the invention.

DETAILED DESCRIPTION OF THE INVENTION

Figure 1A:
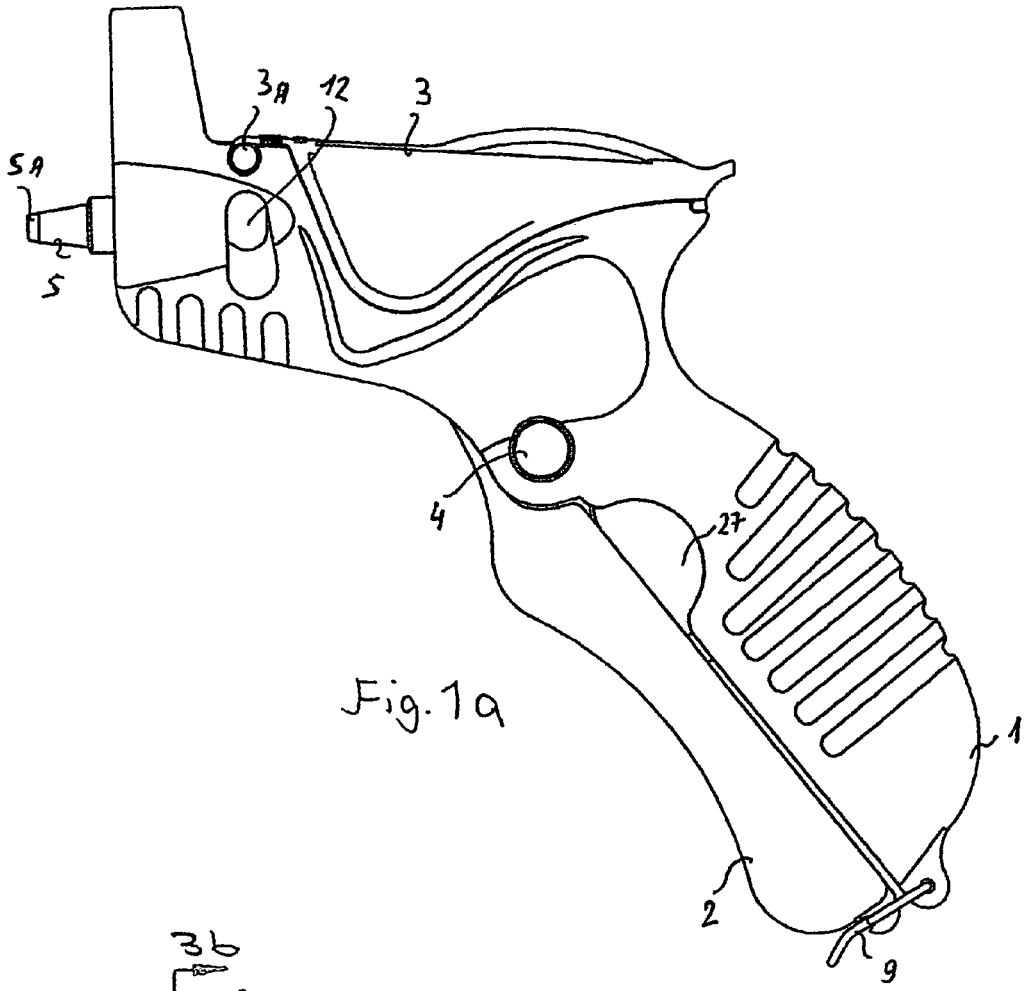
FIGS. 1*a* & 1*b*: A general front and top view of the tool respectively.
Figure 1B:
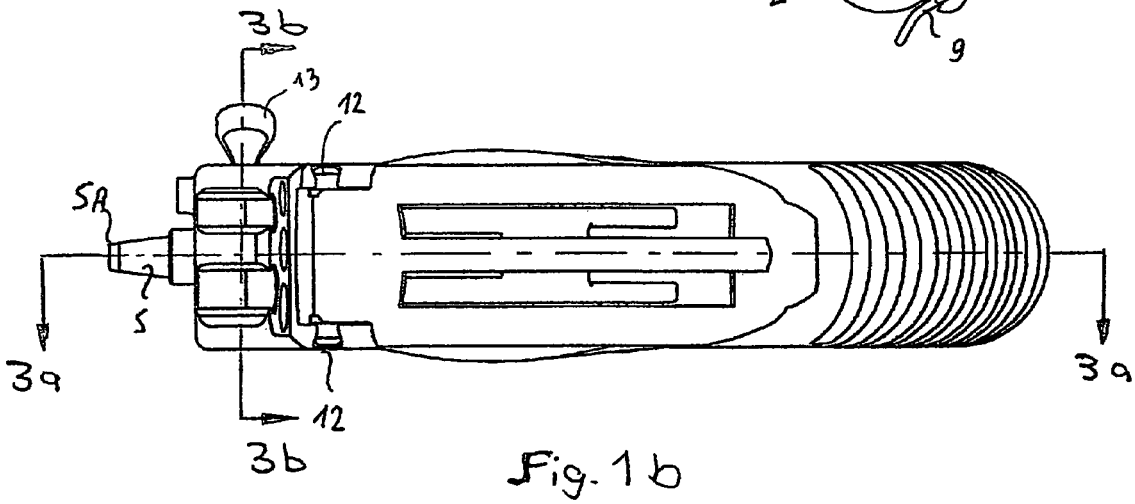

The main parts of the tool are made of high strength molded plastic material, these being the body (1), the handle (2), the cutting blade cover (3), the pin (4) that pivotably connects the handle to the body, and the clasp (13) that rigidly secures a cylindrical blade (5) in place. The other parts of the tool made of steel are the replaceable cylindrical blades (5), the various inserter components (6), the pipe cutting blade (7) the spring (8) that surrounds the pin (4), the spring clasp (9) that arrests the handle when it approaches the body, the screw (10) that holds the cutting blade in place, and the pin (14) on which the clasp (13) moves. All above elements are seen in FIGS. 1*a*, 1*b*, 3*a*, 3*b*.

Referring to FIG. 1*a*, on the front of the body (1) of the tool, is positioned the cylindrical blade (5) whose working edge (5A) is sharpened in order to facilitate its' penetration of the piping. On penetration of the blade (5) into the piping (15), (see FIG. 2*a*), the waste plastic (11) that is cut out, is evacuated through the two lateral openings (12) made at each side of the tool. The tool can be provided with a plurality of interchangeable cylindrical blades (5), having identical outer diameter. The blades are insertable within a dedicated depression made in the front part of the body (not shown). When the user requires to change blades (5), it is done by opening the clasp (13) downwards allowing the blade to be removed, inserting a new blade in the depression and then closing the clasp (13) upwards to secure the new blade (5) in the depression. The clasp (13) moves around the pin (14) that tends away from the center of the clasp (13) thus activating an excentric motion causing the opening and closing of the clasp (13). The cylindrical blade (5) enters the depression in the body (1) of the tool up to a stopper. Each blade has a groove (5B) that is caught in the clasp (13) and this ensures the blade (5) to be reliably secured.

In the open underside (16) of the body (1) of the tool there are provided six storing recesses (18) that are tailored to fit the outer diameter of the cylindrical blades (5) and inserter components (6). (see FIG. 2*b*, FIG. 3*a*). Inside each of these recesses (18) there is a small bump (19) that prevents the blades (5) or inserter components (6) from falling out.

Figure 2A:
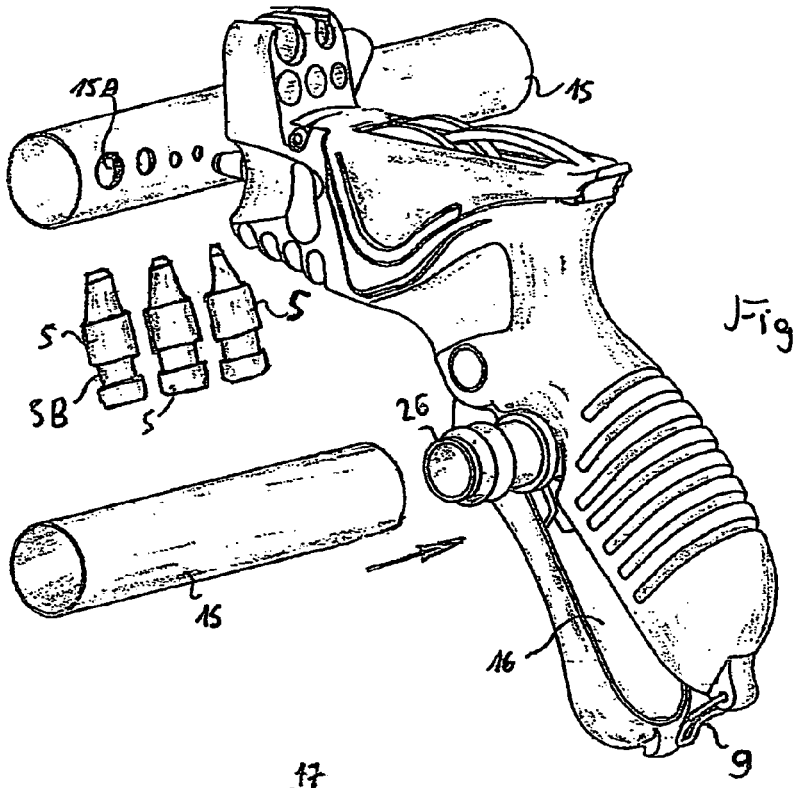
FIGS. 2*a*–*d*: Various views showing different functioning of the tool.
Figure 2B:
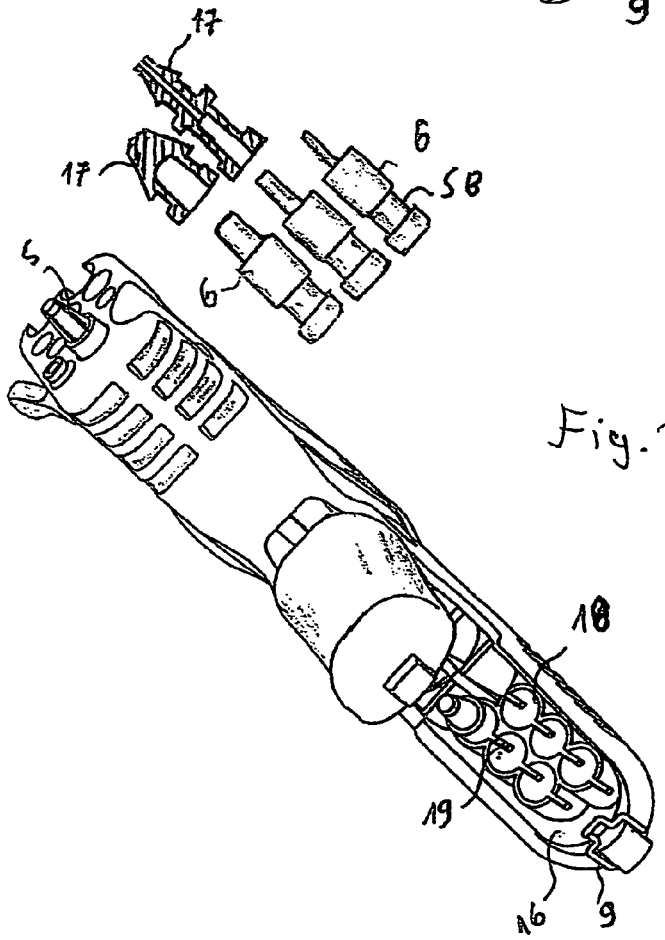
Figure 2C:
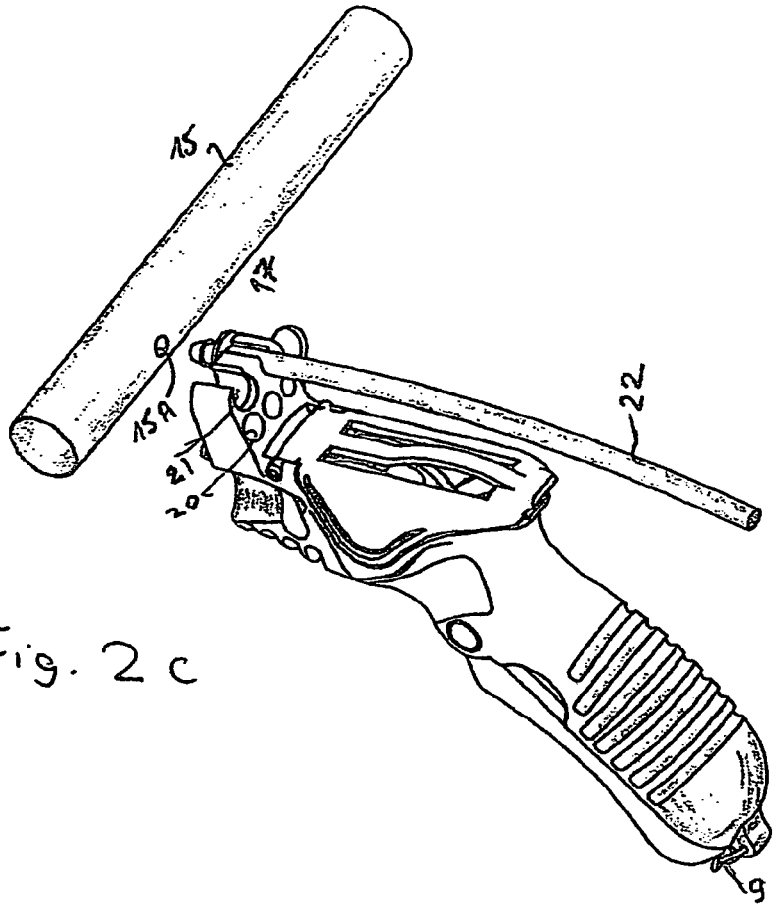
Figure 2D:
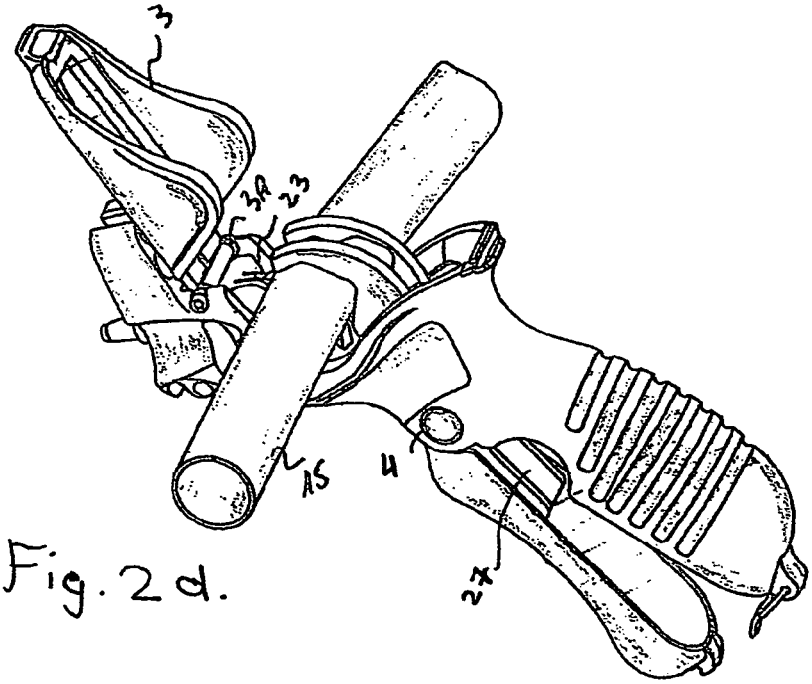
Figure 3A:
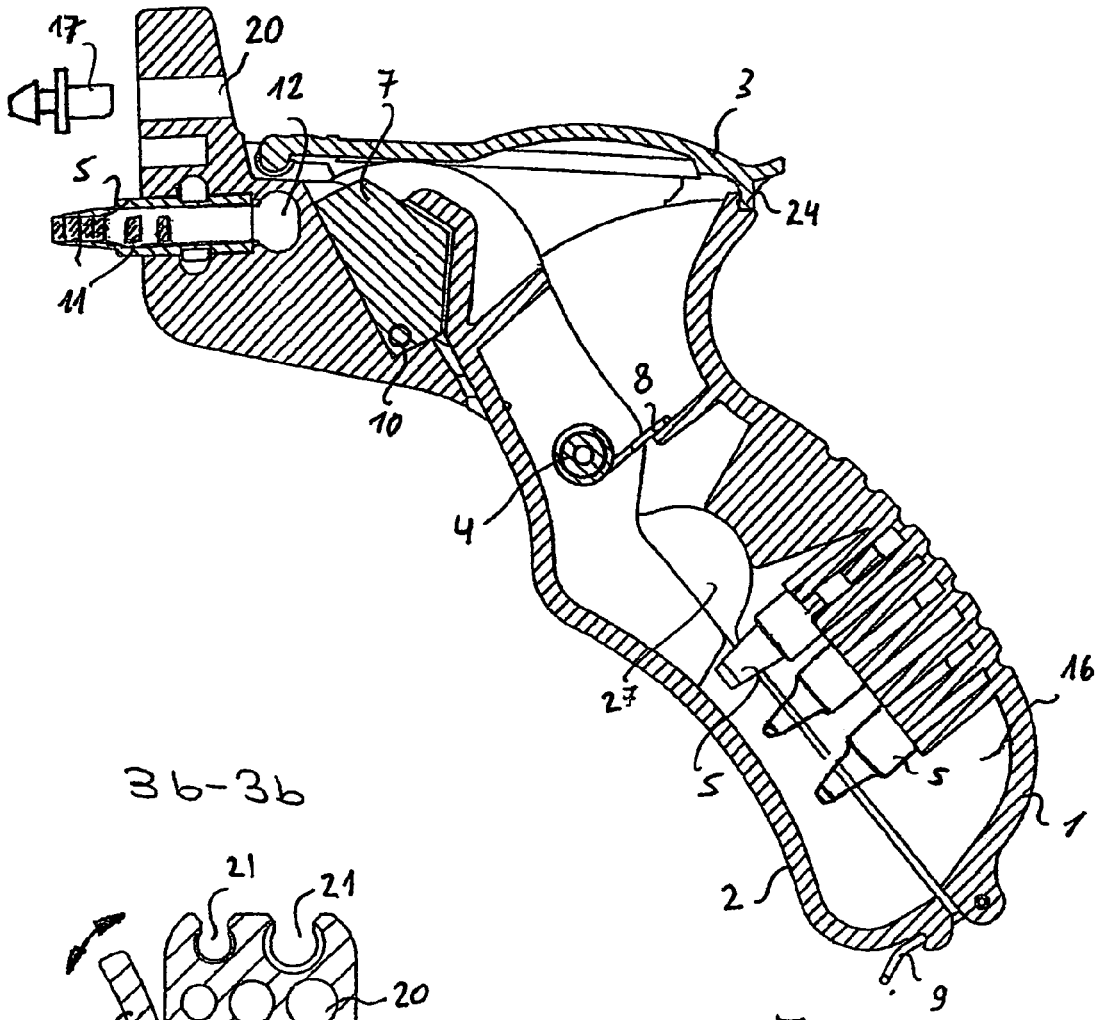
FIG. 3*a*: A cross section of FIG. 1*b* along 3*a*—3*a*.
Figure 3B:
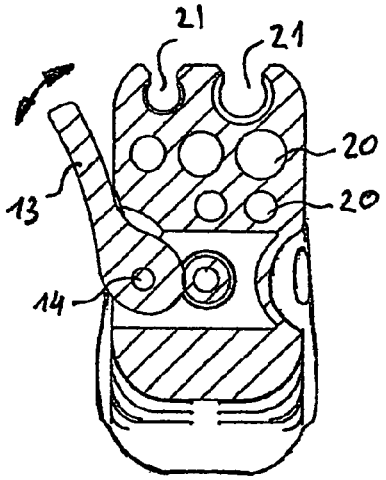
FIG. 3*b*: a cross section of FIG. 1*b* along 3*b*—3*b*.

At the front of the body (1) of the tool and above the working position of the cylindrical blade (5), there are made holes (20) of different diameters into which micro-fittings (17) can be placed according to size suitability (see FIG. 3*b*), and this facilitates the insertion of these fittings (17) into the piping (15) after the hole has been punched (15A), (See FIG. 2*a*). If the blade (5) interferes with the insertion operation, the blade (5) can be removed and placed in one of the storing recesses (18) inside the open underside (16) of the body (1) of the tool. Above the holes (20) there are two different sized open holes (21) which can accommodate a fitting (17) that is already attached to a spaghetti piping (22) in order to insert it into the punched hole (15A) made by the tool in the main piping (15). (See FIG. 2*c*).

Figure 4:
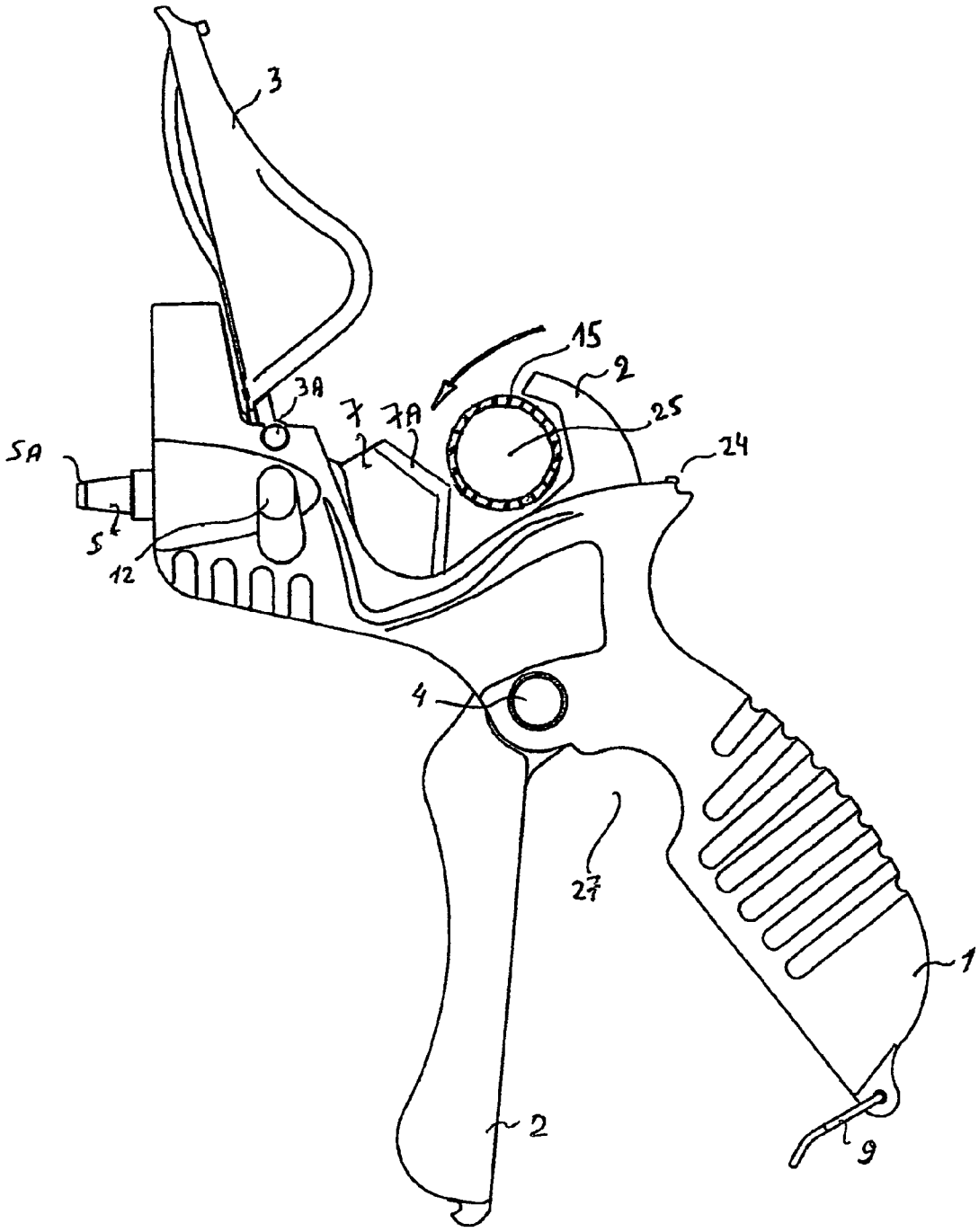
FIG. 4: A front view of the tool when ready to perform cutting of a pipe.

In the body (1) of the tool there is located a cutting blade (7) for the possibility to cut spaghetti piping (22) or a plastic piping (15) of up to 20 mm diameter, to required length (FIG. 4). The cutting blade (7) is made of steel with a well sharpened cutting edge (7A) built in a triangular shape in order to facilitate its' penetration into the piping. (See FIGS. 3*a* & 4). The cutting blade (7) is deployed into a groove (23) made in the body and is held firmly to the body (1) of the tool by a screw (10).

The cutting operation of the piping (15 or 22) is initiated by releasing the handle (2) from the body (1) of the tool by opening the clasp (9). The handle is forcibly pivoted around the pin (4) by virtue of the spring (8).

The handle (2) pivots downwardly, after which the cutting blade cover (3) is then opened by clicking on its rear extremity (24), (see FIG. 3*a*), and the piping (15 or 22) is placed in position in the space (25) between the cutting blade (7) and the prong-shaped top-end of the handle (20), and then by pressing the handle (2) towards the body (1) of the tool the cutting motion is enacted. On completion of the pipe cutting operation, the cutting blade cover (3) is returned to its dosed position by pressing down on its rear extremity (24) and the handle (2) is returned into its original position by closing the clasp (9).

An addition feature of the tool is the easy securing of start connectors (26) in the space (27) between the handle (2) and the body (1). This facilitates the insertion of the connector (26) into the main piping (15). The operation is initiated by opening the handle (2), placing the start connector (26) into the hollow (27), and on pressing the handle (2) towards the body (1) of the tool, the start connector (26) is held firmly and can easily be inserted into the piping (15).

The invention claimed is:

1. A multifunctional handheld tool suitable for performing independently several functions, like punching holes in a plastic pipe, inserting a fitting into a hole made in the pipe, or cutting the pipe to required length, said tool comprising a body having a hollow main portion and a front portion, said front portion being fitted with an opening in which a replaceable tubular cutting blade is rigidly securable so as to be vis-a-vis the pipe and to punch thereof upon applying pressure on the body; said front portion being fitted with at least one additional opening in which a replaceable fitting is deployable so as to be vis-a-vis the pipe for insertion in the hole made in the pipe upon applying pressure to the body; said main portion is further provided with a cutting element, which is rigidly secured in the interior of the main portion;

a handle, which comprises an upper portion located within the main portion of the body and a lower portion, connected to the main portion of the body, said handle is pivotable between a closed and an opened position, wherein when the handle is brought in the opened position the upper portion is distant from the cutting element and the lower portion is distant from the body and when the handle is brought in the closed position the upper portion approaches the cutting element and the lower portion approaches the body, the arrangement being such that when the handle is brought in the opened position a pipe can be placed between the cutting element and the upper portion of the handle and when the handle is brought in the closed position the upper portion urges the tube to approach the cutting element and be cut thereby.

2. The tool as defined in claim 1, in which the front portion is fitted with a fixing means for rigid securing the cutting element within the opening.

3. The tool as defined in claim 2, in which the front portion has lateral holes communicating with the opening, in which the cutting element is secured, said lateral holes are suitable for evacuation of plastic chips produced during the punching.

4. The tool as defined in claim 1, in which the front portion is fitted with a plurality of additional openings, said additional openings having various diameters suitable for accommodating of fittings of different sizes.

5. The tool as defined in claim 1, in which said handle is retained in the opened position by a spring means.

6. The tool as defined in claim 5, in which the main portion of the body is fitted with a locking means for retaining the handle in the closed position.

7. The tool as defined in claim 1, in which said cutting element is flat and said upper portion of the handle is configured as a bifurcated member, having lateral prongs, the arrangement being such that when the handle is brought into dosed position the cutting element is situated between the prongs.

8. The tool as defined in claim 7, in which the interior of the body is closed by a cover and said cover is provided with two elongated slits into which the prongs can enter when the handle is brought in the closed position.

9. The tool as defined in claim 1, in which the main portion of the body is provided with a U-shaped region, said region is suitable for retention therein of a fitting when the handle is brought in the closed position, said fitting is insertable within a pipe.

10. The tool as defined in claim 1, in which at least one storing recess is made in the main portion of the body, said recess is suitable for storing of tubular cutting blades when they are not in use.

* * * * *